US009192875B2

(12) United States Patent
Howard

(10) Patent No.: US 9,192,875 B2
(45) Date of Patent: Nov. 24, 2015

(54) ALL-SHAPE: MODIFIED PLATONIC SOLID BUILDING BLOCK

(71) Applicant: T. Dashon Howard, Plymouth Meeting, PA (US)

(72) Inventor: T. Dashon Howard, Plymouth Meeting, PA (US)

(73) Assignee: T. Dashon Howard, Lafayette Hill, PA (US)

( * ) Notice: Subject to any disclaimer, the term of this patent is extended or adjusted under 35 U.S.C. 154(b) by 0 days.

(21) Appl. No.: 14/029,630

(22) Filed: Sep. 17, 2013

(65) Prior Publication Data

US 2015/0079870 A1 Mar. 19, 2015

(51) Int. Cl.
*A63H 33/12* (2006.01)
*A63H 33/04* (2006.01)

(52) U.S. Cl.
CPC ..... *A63H 33/046* (2013.01)

(58) Field of Classification Search
CPC ... A63H 33/04; A63H 33/044; A63H 33/046; A63H 33/048; A63H 33/06
USPC ..... 446/92, 102, 108, 111, 112, 122, 124, 446/125; 434/211; 273/157 R; 52/578
See application file for complete search history.

(56) References Cited

U.S. PATENT DOCUMENTS

| | | | | |
|---|---|---|---|---|
| 1,292,188 | A | 1/1919 | Wheeler | |
| 2,688,820 | A | 9/1954 | Shemet | |
| 2,843,971 | A * | 7/1958 | Gardellin | 446/126 |
| 3,359,657 | A | 12/1967 | Hedberg | |
| 3,564,758 | A | 2/1971 | Willis | |
| 3,654,375 | A | 4/1972 | Geiger | |
| 3,655,201 | A * | 4/1972 | Nichols | 273/153 R |
| 3,662,486 | A * | 5/1972 | Freedman | 446/120 |
| 3,666,607 | A | 5/1972 | Weissman | |
| 3,728,201 | A * | 4/1973 | Stroehmer | 428/9 |
| 3,782,029 | A * | 1/1974 | Bardot | 446/121 |
| 3,785,066 | A | 1/1974 | Tuitt | |
| 4,026,087 | A * | 5/1977 | White | 52/608 |
| 4,064,662 | A * | 12/1977 | O'Toole | 52/71 |
| 4,258,479 | A * | 3/1981 | Roane | 434/211 |
| 4,380,133 | A | 4/1983 | Arnstein | |

(Continued)

FOREIGN PATENT DOCUMENTS

| | | |
|---|---|---|
| BE | 898431 A1 | 6/1984 |
| CA | 2214697 A1 | 6/1998 |

(Continued)

OTHER PUBLICATIONS

"Ball of Whacks", [online], © 1996-2013, Amazon.com, Inc. [archived on Sep. 1, 2013], Retrieved from the Internet: <URL: https://web.archive.org/web/20130901214911/http://www.amazon.com/Creative-Whack-BOW30-Ball-Whacks/dp/0911121013>, (2013), 5 pgs.

(Continued)

*Primary Examiner* — Kurt Fernstrom
(74) *Attorney, Agent, or Firm* — Schwegman Lundberg & Woessner, P.A.

(57) ABSTRACT

All-shape building blocks may be shaped as platonic solids. All-Shape building blocks may be modified to include a flange on each tetrahedron edge, where each flange and each tetrahedron vertex may include magnetic materials (e.g., magnets, ferromagnetic metals). All-Shape building blocks may be combined to form or provide an optical appearance of various geometric structures, and the included magnetic materials may be used to retain the formed geometric structure shape.

20 Claims, 5 Drawing Sheets

(56) References Cited

U.S. PATENT DOCUMENTS

| | | | | |
|---|---|---|---|---|
| 4,492,723 | A * | 1/1985 | Chadwick, II | 428/7 |
| 4,864,796 | A * | 9/1989 | Diamond | 52/646 |
| 5,104,125 | A | 4/1992 | Wilson | |
| 5,108,100 | A | 4/1992 | Essebaggers et al. | |
| 5,205,556 | A | 4/1993 | Stallman | |
| 5,429,515 | A | 7/1995 | Greenwood | |
| 5,489,230 | A | 2/1996 | Gavula, Jr. et al. | |
| 5,895,306 | A | 4/1999 | Cunningham | |
| 5,961,365 | A | 10/1999 | Lambert et al. | |
| 6,264,199 | B1 | 7/2001 | Schaedel | |
| 6,293,800 | B1 * | 9/2001 | Robertson | 434/196 |
| D457,833 | S | 5/2002 | Juan et al. | |
| 6,431,936 | B1 | 8/2002 | Kiribuchi | |
| 6,443,796 | B1 | 9/2002 | Shackelford | |
| 6,524,161 | B1 | 2/2003 | Asami | |
| 6,585,553 | B1 | 7/2003 | Fetridge et al. | |
| 6,749,480 | B1 * | 6/2004 | Hunts | 446/92 |
| 6,895,722 | B1 * | 5/2005 | Ponder | 52/578 |
| 7,018,690 | B2 | 3/2006 | Lee | |
| 7,708,615 | B2 | 5/2010 | Munch | |
| 8,047,889 | B2 * | 11/2011 | Ishii | 446/85 |
| D660,685 | S * | 5/2012 | Bucci | D8/354 |
| 8,398,268 | B2 * | 3/2013 | Elberbaum et al. | 362/249.16 |
| 8,507,778 | B2 | 8/2013 | Olson | |
| 8,753,164 | B2 | 6/2014 | Hansen et al. | |
| 8,911,275 | B2 | 12/2014 | Maddocks et al. | |
| 8,979,608 | B2 | 3/2015 | Hawthorne | |
| 2001/0021619 | A1 * | 9/2001 | Forkman | 446/129 |
| 2001/0041493 | A1 | 11/2001 | Esterle | |
| 2003/0153243 | A1 | 8/2003 | Haas | |
| 2006/0252340 | A1 | 11/2006 | Bach et al. | |
| 2007/0037469 | A1 * | 2/2007 | Yoon | 446/92 |
| 2008/0073999 | A1 | 3/2008 | Wischnewskij et al. | |
| 2009/0309302 | A1 | 12/2009 | Langin-Hooper | |
| 2011/0001394 | A1 | 1/2011 | Piazza | |
| 2011/0043079 | A1 | 2/2011 | Shirai et al. | |
| 2012/0122059 | A1 | 5/2012 | Schweikardt et al. | |
| 2013/0165012 | A1 * | 6/2013 | Klauber et al. | 446/91 |
| 2013/0217294 | A1 | 8/2013 | Karunaratne | |
| 2014/0227934 | A1 * | 8/2014 | Rudisill | 446/92 |
| 2015/0079871 | A1 | 3/2015 | Howard | |
| 2015/0079872 | A1 | 3/2015 | Howard | |

FOREIGN PATENT DOCUMENTS

| | | | |
|---|---|---|---|
| CN | 201643725 | U | 11/2010 |
| DE | 19617526 | A1 | 5/1997 |
| EP | 0261753 | A2 | 3/1988 |
| FR | 2114528 | A5 | 6/1972 |
| GB | 1603060 | A | 11/1981 |
| GB | 2302344 | A | 1/1997 |
| KR | 200454067 | Y1 | 6/2011 |
| WO | WO-9535142 | A1 | 12/1995 |
| WO | WO-2006040852 | A1 | 4/2006 |
| WO | WO-2008043535 | A1 | 4/2008 |
| WO | WO-2015042172 | A1 | 3/2015 |
| WO | WO-2015077760 | A1 | 5/2015 |
| WO | WO-2015116928 | A1 | 8/2015 |

OTHER PUBLICATIONS

"Magna-Tiles Clear Colors 32 piece set", [online], © 1996-2013, Amazon.com, Inc. [archived on Sep. 8, 2013]. Retrieved from the Internet: http://www.amazon.com/Magna-Tiles-Clear-Colors-piece-set/dp/B000CBSNKQ/, (2013), 5 pgs.

"Toy / Game Popular Playthings Mag-Blocks", [online]. © 1996-2014, Amazon.com, Inc. [retrieved on Apr. 28, 2014], Retrieved from the Internet: <URL: http://www.amazon.com/Game-Popular-Playthings-Mag-Blocks-Easy-To-Handle/dp/B00CGG75JA/>, (2014), 3 pgs.

"U.S. Appl. No. 14/089,599, Response filed Dec. 22, 2014 to Restriction Requirement mailed Oct. 22, 2014.", 6 pgs.

"U.S. Appl. No. 14/089,599, Restriction Requirement mailed Oct. 22, 2014", 6 pgs.

"International Application Serial No. PCT/US2014/056130, International Search Report mailed Nov. 27, 2014", 5 pgs.

"International Application Serial No. PCT/US2014/056130, Written Opinion mailed Nov. 27, 2014", 5 pgs.

"U.S. Appl. No. 14/089,599, Non Final Office Action mailed Feb. 23, 2015", 9 pgs.

"U.S. Appl. No. 14/170,372, Restriction Requirement mailed Feb. 26, 2015", 5 pgs.

U.S. Appl. No. 14/089,599, Notice of Allowance mailed Apr. 2, 2015, 6 pgs.

U.S. Appl. No. 14/089,599, Response filed Mar. 13, 2015 to Non Final Office Action mailed Feb. 23, 2015, 7 pgs.

U.S. Appl. No. 14/170,372, Non Final Office Action mailed May 18, 2015, 7 pgs.

U.S. Appl. No. 14/170,372, Response filed Apr. 23, 2015 to Restriction Requirement mailed Feb. 26, 2015, 6 pgs.

International Application Serial No. PCT/US2014/067330, International Search Report mailed Feb. 17, 2015, 4 pgs.

International Application Serial No. PCT/US2014/067330, Written Opinion mailed Feb. 17, 2015, 7 pgs.

International Application Serial No. PCT/US2015/013766, International Search Report mailed May 11, 2015, 4 pgs.

International Application Serial No. PCT/US2015/013766, Written Opinion mailed May 11, 2015, 5 pgs.

U.S. Appl. No. 14/245,249, Non Final Office Action mailed Jun. 30, 2015, 7 pgs.

International Application Serial No. PCT/US2015/023973, International Search Report mailed Jun. 18, 2015, 4 pgs.

International Application Serial No. PCT/US2015/023973, Written Opinion mailed Jun. 18, 2015, 5 pgs.

U.S. Appl. No. 14/170,372, Response filed Aug. 18, 2015 to Non Final Office Action mailed May 18, 2015, 8 pgs.

U.S. Appl. No. 14/539,829, Restriction Requirement mailed Oct. 1, 2015, 8 pgs.

International Application Serial No. PCT/US2015/013766 International Preliminary Report on Patentability, 10 pgs.

* cited by examiner

ALL-SHAPE: MODIFIED PLATONIC SOLID BUILDING BLOCK

FIELD

The present invention relates to building blocks, and specifically to magnetic educational toy blocks.

BACKGROUND

Building blocks may be assembled in various configurations to form different geometric structures. Groups of building blocks may be used as an educational toy by children, or may be used by adults or children to explore various three-dimensional shapes.

DETAILED DESCRIPTION

Building blocks may be shaped as platonic solids. All-Shape building blocks may be modified to include a flange on each tetrahedron edge, where each flange and each tetrahedron vertex may include magnetic materials (e.g., magnets, ferromagnetic metals). All-Shape building blocks may be combined to form or give the appearance of various geometric structures, and the included magnetic materials may be used to retain the formed geometric structure shape.

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

Figure 1:
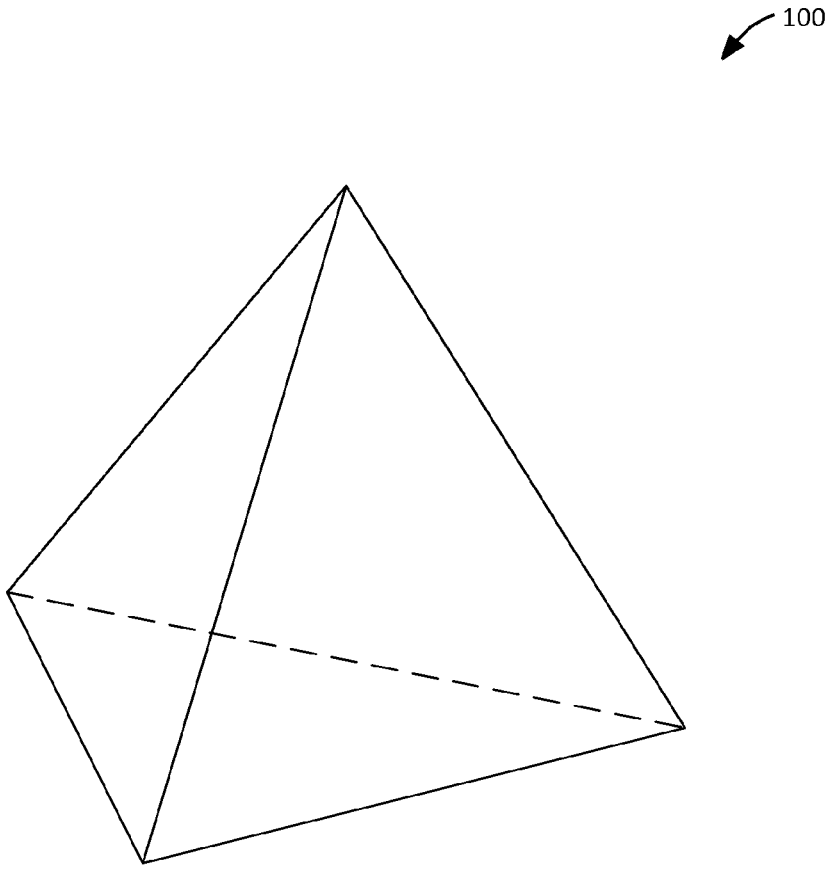
FIG. 1 is a perspective view of an All-Shape building block.

FIG. 1 is a perspective view 100 of an All-Shape building block. An example tetrahedron is formed of four triangular faces, and may be thought of as a triangular pyramid. Each tetrahedron includes four vertices, and includes six edges. Each of the triangular faces may be formed using an equilateral, isosceles, or scalene triangle, provided that the triangular faces meet to form the four vertices and six edges.

Figure 2:
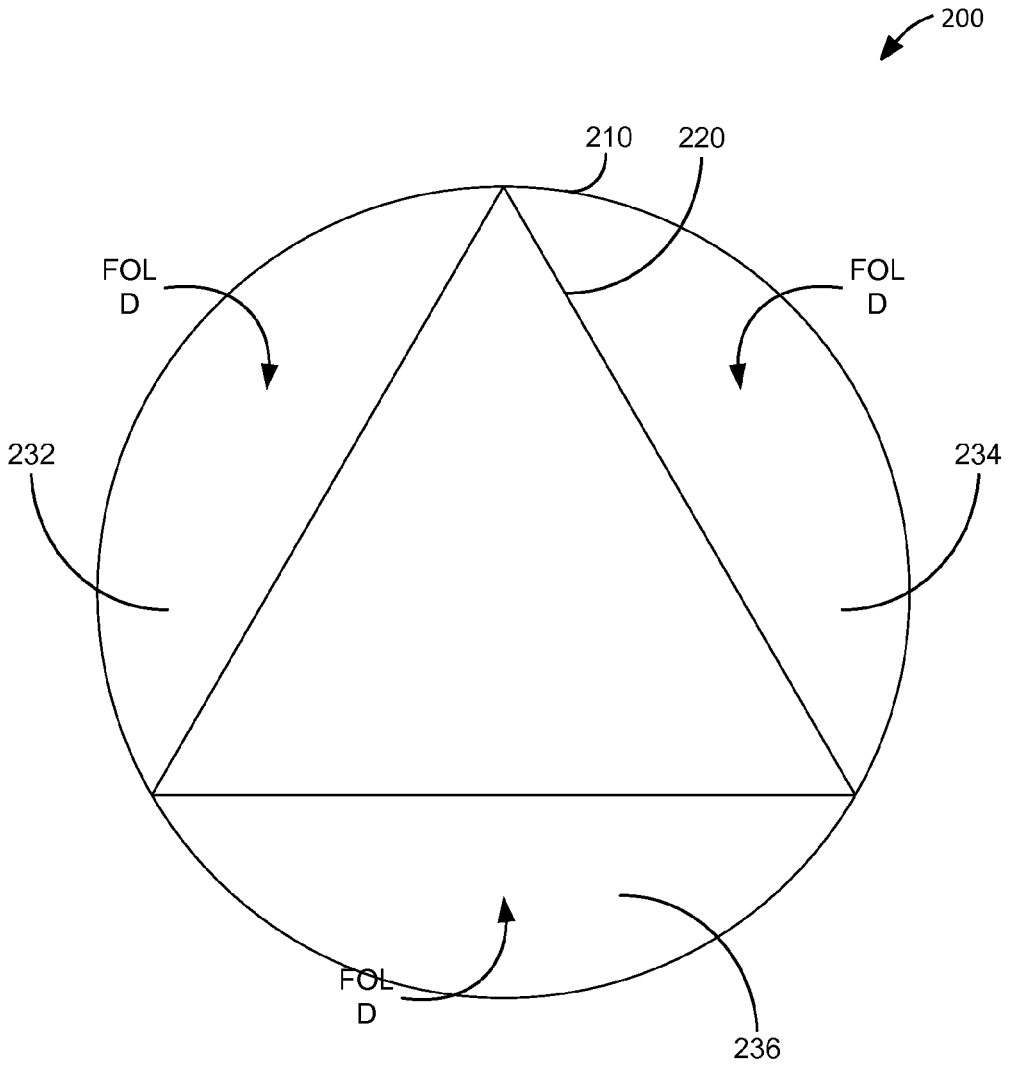
FIG. 2 is a front view of a circular face of an All-Shape building block.

FIG. 2 is a front view 200 of a circular face of an All-Shape building block. The face in FIG. 2 is shown as a circle 210, though ellipsoid or other shapes may be used. The circular face 210 may be made of a transparent material, and may be of a uniform or nonuniform thickness. For example, the cross-section of the circular face 210 may be convex or concave, and may be used as a lens in various optical applications. The circular face 210 may include various color patterns. The circular face 210 may circumscribe a triangle 220, such as a triangular face of a tetrahedron. The triangle may be comprised of three one hundred and twenty degree angles, such as in an equilateral triangle.

Various additional ornamental designs may be used on each side of the circular face 210, and may include a straight line on each side of the circumscribed triangle 220. The straight line may be a projection of the triangle edge, where two such lines at a triangle vertex form a one hundred and twenty degree angle. Various designs may include lines comprised of magnetic tape, where information may be encoded or transferred using the magnetic tape. For example, standard magnetic tape encoders and readers may be used to record or read information encoded on a magnetic tape stripe on an exterior surface. Various designs may include lines comprised of electrically conductive materials, such as copper. The circular face 210 may be constructed using a flexible material to allow the three portions of the circular face extending beyond the inscribed triangle to be folded toward the viewer to form flanges 232, 234, and 236. In another embodiment, the circular face 210 and flanges 232, 234, and 236 are constructed using a semi-flexible or inflexible material and connected at each triangle edge using a hinge, where the hinge may be constructed using a flexible material or a mechanical hinge. The flanges of four such circular faces may be connected to form an All-Shape building block, such as is shown in FIG. 3.

Figure 3:
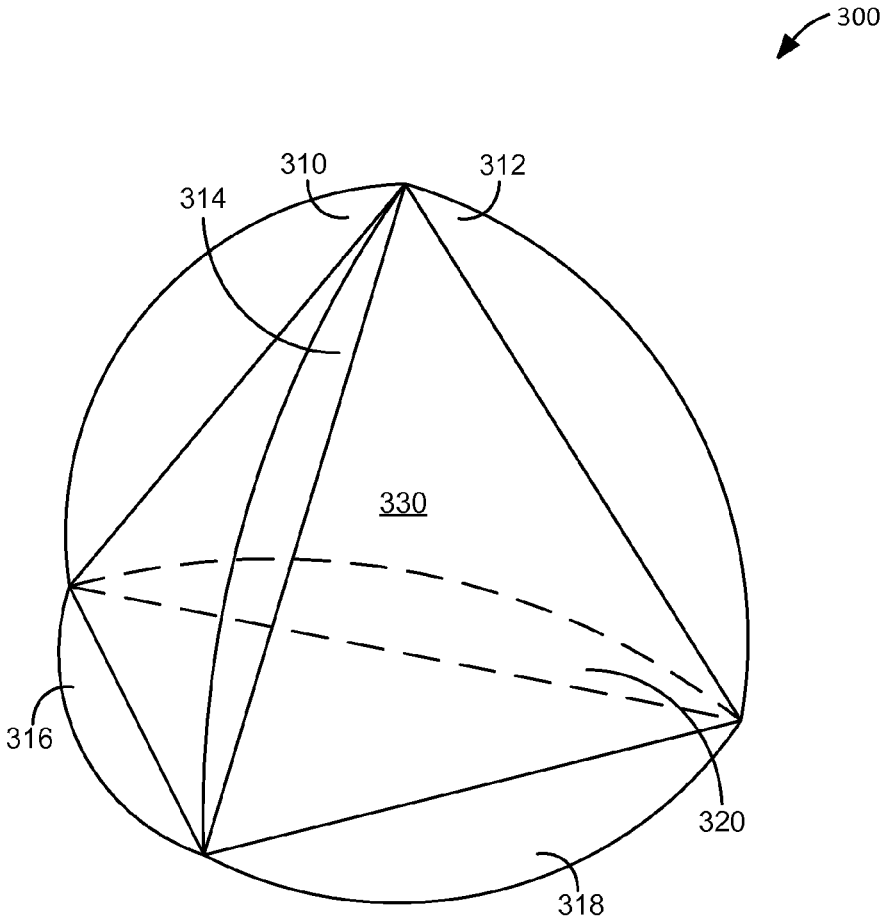
FIG. 3 is a perspective view of an All-Shape building block.

FIG. 3 is a perspective view 300 of an All-Shape building block. The All-Shape building block includes four connected circular faces. The flanges of four such circular faces are connected to form All-Shape flanges 310, 312, 316, 318, and 320. The triangles inscribed in each of the four connected circular faces form a tetrahedral inner space 330. The All-Shape flanges 310, 312, 316, 318, and 320 define a spherical volume that corresponds with the circumscribed sphere (e.g., circumsphere) surrounding the tetrahedral inner space 330.

The All-Shape building block may be transparent, may be translucent, may include a semi-transparent material comprised of a color, or may include a solid (e.g., opaque) material. The tetrahedral inner space 330 may include one or more gasses, such as noble gasses or gasses that are translucent or colored. The tetrahedral inner space 330 may include one or more fluids, such as a suspended particle fluid that transitions from a clouded appearance to a translucent appearance in the presence of an electrical voltage. Various levels of transparency or various shades of color may be used for the each side of the tetrahedral inner space 330 or for each of the All-Shape flanges 310, 312, 316, 318. The use of semi-transparent materials of various colors may allow the colors to be combined depending on orientation. For example, if the device is held so a blue face is superimposed on a yellow face, the object may appear green. Similarly, multiple All-Shape building blocks may be combined to yield various colors. Multiple All-Shape building blocks may be combined to form the appearance of various platonic solids, where the platonic solid appearance may depend on each All-Shape building block's specific periodicities of motion and wave positions in time as indicated by the direction of particular intersecting linear projections. For example, the vertices of four All-Shape building blocks using tetrahedral configurations may be combined to form a larger tetrahedron, where the larger tetrahedron maintains the one hundred and twenty degree angle at each of its vertices.

The All-Shape building block may alter its appearance based on the presence of electrical current. For example, using electrochemical materials, application of an electrical current may transition one or more surfaces of the All-Shape building block to translucent, clouded, or colored. A solid All-Shape building block may be used to conduct vibration, such as in acoustic or other applications. For example, induced mechanical vibration may be used in vibration therapy. The All-Shape building block may be constructed using a conductive material for various electrical applications. For example, one or more of the faces of the All-Shape building block may be comprised of silicon, where the silicon is arranged to function as a resistor, inductor, capacitor, microchip (e.g., integrated circuit), or other electrical component.

Figure 4:
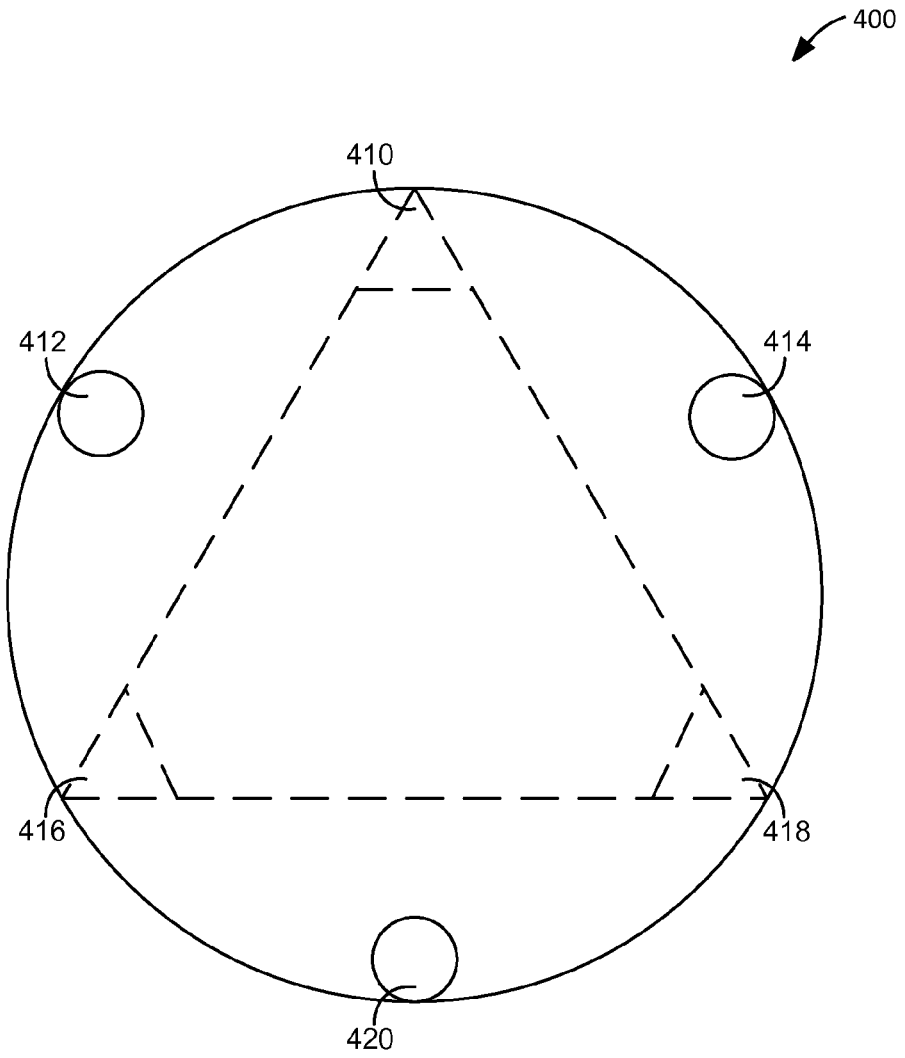
FIG. 4 is a front view of magnetic material placement within the circular face of the All-Shape building block.

FIG. 4 is a front view 400 of magnetic material placement within the circular face of the All-Shape building block. Each face may include magnetic material within each of six locations 410, 412, 416, 418, and 420. In some embodiments, each of six locations 410, 412, 416, 418, and 420 may form vacant spaces when four circular faces are connected to form an All-Shape building block. For example, flange locations 412, 414, and 420 may form disc-shaped vacant spaces, and vertex locations 410, 416, and 418 may form smaller tetrahedron-shaped vacant spaces, such as is shown in FIG. 5.

Figure 5:
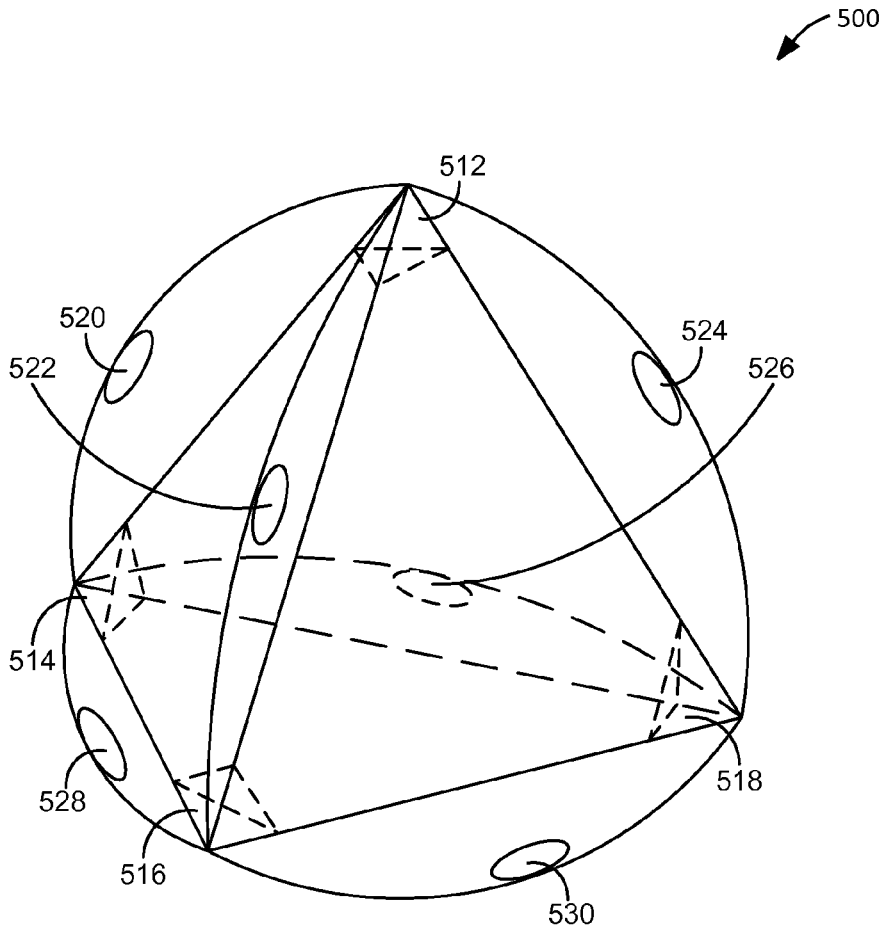
FIG. 5 is a perspective view of an All-Shape building block with magnetic materials.

FIG. 5 is a perspective view 500 of an All-Shape building block with magnetic materials. The vertices of the tetrahedron may include four tetrahedron-shaped vacant spaces 512, 514, 516, 518 for retaining magnetic material. The tetrahedron-shaped vacant spaces 512, 514, 516, 518 may retain magnetic material in a fixed position, or may allow magnetic material to shift in response to attraction or repulsion from other magnetic materials. For example, a vertex from one All-Shape building block is brought in close proximity to a vertex from another All-Shape building block, the magnets within each vertex may reorient themselves such that the vertices attract and secure the vertices to each other. Similarly, the flanges of the circular faces may include six disc-shaped vacant spaces 520, 522, 524, 526, 528, 530 for retaining magnetic material, which may retain magnetic material in a fixed position or allow magnetic material to shift in response to attraction or repulsion from other magnetic materials. The magnetic material may be used to arrange multiple All-Shape building blocks, or multiple non-magnetic blocks may be stacked, grouped in a pile, arranged on a flat surface, glued, or held together by any other means.

The combination of the four tetrahedron-shaped vacant spaces 512, 514, 516, 518 and six disc-shaped vacant spaces 520, 522, 524, 526, 528, 530 may be arranged to focus energy on a point within or external to the All-Shape building block. For example, the magnetic material may be arranged to create a positive magnetic polarity on two of the four faces of the All-Shape building block and a negative polarity on the other two faces. Similarly, when conductive material is used on or within the All-Shape building block, the magnetic material may be used to create a positive or negative polarity on a region of the All-Shape building block.

This invention is intended to cover all changes and modifications of the example embodiments described herein that do not constitute departures from the scope of the claims.

What is claimed is:

1. A building block comprising:

a tetrahedron including six edges and four vertices; and an arcuate flange disposed on each of the six edges, the curvature of the flange arc selected to enable connecting at least one arcuate flange on the building block with a second building block arcuate flange.

2. The building block of claim 1, further including a magnetic material disposed within each flange.

3. The building block of claim 2, wherein:

each flange includes a disc-shaped space; and the magnetic material disposed within the disc-shaped space within each flange.

4. The building block of claim 3, wherein the flanges are flexibly attached to each of the six edges to allow magnetic attachment to a magnetic material building block.

5. The building block of claim 1, further including a magnetic material disposed within each of the four vertices.

6. The building block of claim 5, wherein:

each vertex includes a tetrahedron-shaped space; and the magnetic material disposed within the tetrahedron-shaped space within each vertex.

7. The building block of claim 6, wherein a geometry of each magnetic material is arranged to allow the magnetic material to reorient itself in response to attraction or repulsion from other magnetic materials.

8. The building block of claim 1, further including a plurality of conductive lines disposed on the surface of the building block.

9. The building block of claim 1, further including a plurality of magnetic strips disposed on the surface of the building block, wherein the plurality of magnetic strips are magnetically encoded with information.

10. The building block of claim 1, wherein:

the tetrahedron includes four sides; and the four sides are formed from a colored and semi-transparent material to allow a viewer to generate various color combinations by reorienting the building block.

11. A method of forming a building block, the building block including a tetrahedron including six edges and four vertices and a flange disposed on each of the six edges, the method comprising:

coupling a first disc to a second disc along a first common chord to form a first flange;

coupling a third disc to the first disc along a second common chord to form a second flange;

coupling the third disc to the second disc along a third common chord to form a third flange;

coupling a fourth disc to the first disc along a fourth common chord to form a fourth flange;

coupling the fourth disc to the second disc along a fifth common chord to form a fifth flange;

coupling the fourth disc to the third disc along a sixth common chord to form a sixth flange and a tetrahedral inner volume, the tetrahedral inner volume including six edges and four vertices;

wherein the first, second, third, fourth, fifth, and sixth common chords form the six tetrahedral inner volume edges.

12. The method of claim 11, further including disposing a magnetic material within each flange.

13. The method of claim 12, wherein disposing a magnetic material within each flange includes disposing a magnetic material within a disc-shaped space within each flange.

14. The method of claim 13, wherein forming the first, second, third, fourth, fifth, and sixth flanges includes forming flexible flanges to allow magnetic attachment to a magnetic material building block.

15. The method of claim 11, further including disposing a magnetic material within each of the four vertices.

16. The method of claim 15, wherein disposing a magnetic material within each of the four vertices includes disposing a magnetic material within a tetrahedron-shaped space within each vertex.

17. The method of claim 16, wherein a geometry of each magnetic material is arranged to allow the magnetic material to reorient itself in response to attraction or repulsion from other magnetic materials.

18. The method of claim 11, further including disposing a plurality of conductive lines on the surface of the building block.

19. The method of claim 11, further including disposing a plurality of magnetic strips on the surface of the building block, wherein the plurality of magnetic strips are magnetically encoded with information.

20. A building block comprising:

a tetrahedron including six edges and four vertices;

a flange disposed on each of the six edges; and a magnetic material disposed within each of the four vertices.

* * * * *